US011820584B2

(12) United States Patent
VanBecelaere

(10) Patent No.: US 11,820,584 B2
(45) Date of Patent: Nov. 21, 2023

(54) AEROSOL SPRAYERS AND METHODS OF USING THE SAME

(71) Applicant: Silgan Dispensing Systems Corporation, Richmond, VA (US)

(72) Inventor: Jacob VanBecelaere, Olathe, KS (US)

(73) Assignee: Silgan Dispensing Systems Corporation, Richmond, VA (US)

( * ) Notice: Subject to any disclaimer, the term of this patent is extended or adjusted under 35 U.S.C. 154(b) by 0 days.

(21) Appl. No.: 17/681,732

(22) Filed: Feb. 26, 2022

(65) Prior Publication Data

US 2023/0271769 A1 Aug. 31, 2023

(51) Int. Cl.
*B65D 83/20* (2006.01)
*B65D 83/22* (2006.01)
*B65D 83/44* (2006.01)

(52) U.S. Cl.
CPC ..... *B65D 83/206* (2013.01); *B65D 83/222* (2013.01); *B65D 83/44* (2013.01)

(58) Field of Classification Search
CPC ..... B65D 83/206; B65D 83/222; B65D 83/44
See application file for complete search history.

(56) References Cited

U.S. PATENT DOCUMENTS

| | | | | |
|---|---|---|---|---|
| 3,734,353 | A | 5/1973 | McIlhenny | |
| 4,157,774 | A | 6/1979 | Micallef | |
| 7,172,098 | B2 | 2/2007 | Garcia et al. | |
| 7,780,045 | B2 | 8/2010 | Rossignol | |
| 8,056,771 | B2 | 11/2011 | Rossignol | |
| 8,528,837 | B2 | 9/2013 | Kwasny | |
| 9,586,750 | B1 * | 3/2017 | Mangold | B65D 83/202 |
| 11,440,726 | B1 * | 9/2022 | Beegle | B65D 83/22 |
| 2002/0134798 | A1 * | 9/2002 | Lamboux | B65D 83/267 222/251 |
| 2004/0222246 | A1 * | 11/2004 | Bates | B05B 11/1052 222/402.15 |
| 2008/0023498 | A1 * | 1/2008 | Bertin | B65D 83/56 222/320 |
| 2008/0221561 | A1 * | 9/2008 | Geiger | B65D 83/303 606/22 |
| 2010/0059551 | A1 * | 3/2010 | Tomkins | B65D 83/206 222/402.15 |
| 2010/0224655 | A1 * | 9/2010 | Ramet | B05B 11/1045 222/402.13 |

FOREIGN PATENT DOCUMENTS

AU 2015100094 A4 3/2005

* cited by examiner

*Primary Examiner* — Bob Zadeh
(74) *Attorney, Agent, or Firm* — Hinckley Allen & Snyder; Stephen Holmes

(57) ABSTRACT

An aerosol sprayer may be connected to an aerosol container to form an aerosol delivery system. The aerosol sprayer includes a base secured to the container, a cap secured to the base, a pivoting trigger and a sliding nozzle body with an integrated nozzle/manifold which is slidably movable relative to the trigger between an extended operable position and a retracted, locked position. The nozzle includes flexible articulating wall structures adjacent to the manifold to accommodate movement of the nozzle body. The nozzle and trigger have interfitting locking structures to prevent actuation of the trigger when the nozzle is in the retracted locked position.

17 Claims, 11 Drawing Sheets

AEROSOL SPRAYERS AND METHODS OF USING THE SAME

BACKGROUND OF THE INVENTION (1) Field of the Invention: The instant invention relates to aerosol sprayer devices and more particularly to an aerosol spray actuator having a slidably extending nozzle with a locking mechanism.

(2) Description of Related Art: Aerosol spray devices typically include a pushbutton spray device containing an orifice and a connection to a valve which is in turn connected to a container of product from which the aerosol product is dispensed. Actuation of the pushbutton releases a quantity of product from the aerosol container through the valve and pushbutton orifice.

More recently aerosol spray devices have been modified to look and function more like trigger sprayers and such devices may include a trigger attached to, or in operable communication with, a manifold which is in turn connected to the valve stem of an aerosol container. While trigger actuation is a recognized improvement for aerosol sprayers, accidental and inadvertent actuation of the trigger during both shipment and use is an ongoing issue of concern.

SUMMARY OF THE INVENTION

According to exemplary embodiments of the invention, an aerosol trigger-type sprayer device may include a unique and novel sliding nozzle assembly which prevents aerosol fluid from dripping on the user's fingers during or after actuating the trigger and an integrated locking mechanism which will prevent actuation of the trigger when the nozzle is retracted.

Some embodiments of the aerosol sprayer may generally comprise a base configured to be received in assembled relation with an aerosol container, a cap received with the base, a nozzle with an integrated manifold, an elongated sliding nozzle body slidably movable within the cap, a trigger pivotably attached to the base and operably engaged with the manifold, and a trigger locking mechanism.

The nozzle includes a discharge orifice at an outlet end which is secured within an outlet end of the nozzle body, an aerosol stem manifold at an inlet end, and a discharge conduit extending therebetween wherein at least a portion of the discharge conduit adjacent to the manifold comprises flexible, articulating accordion-like wall structures to accommodate movement of the sliding nozzle body.

The nozzle body and the cap are configured and arranged for sliding movement of the nozzle body within the cap between a retracted (locked for shipping and storage) position and an extended operable position (unlocked).

In some embodiments, the locking mechanism comprises one or more latch arms on the trigger and corresponding latch receivers on the nozzle body.

While embodiments of the invention have been described as having the features recited, it is understood that various combinations of such features are also encompassed by particular embodiments of the invention and that the scope of the invention is limited by the claims and not the description.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
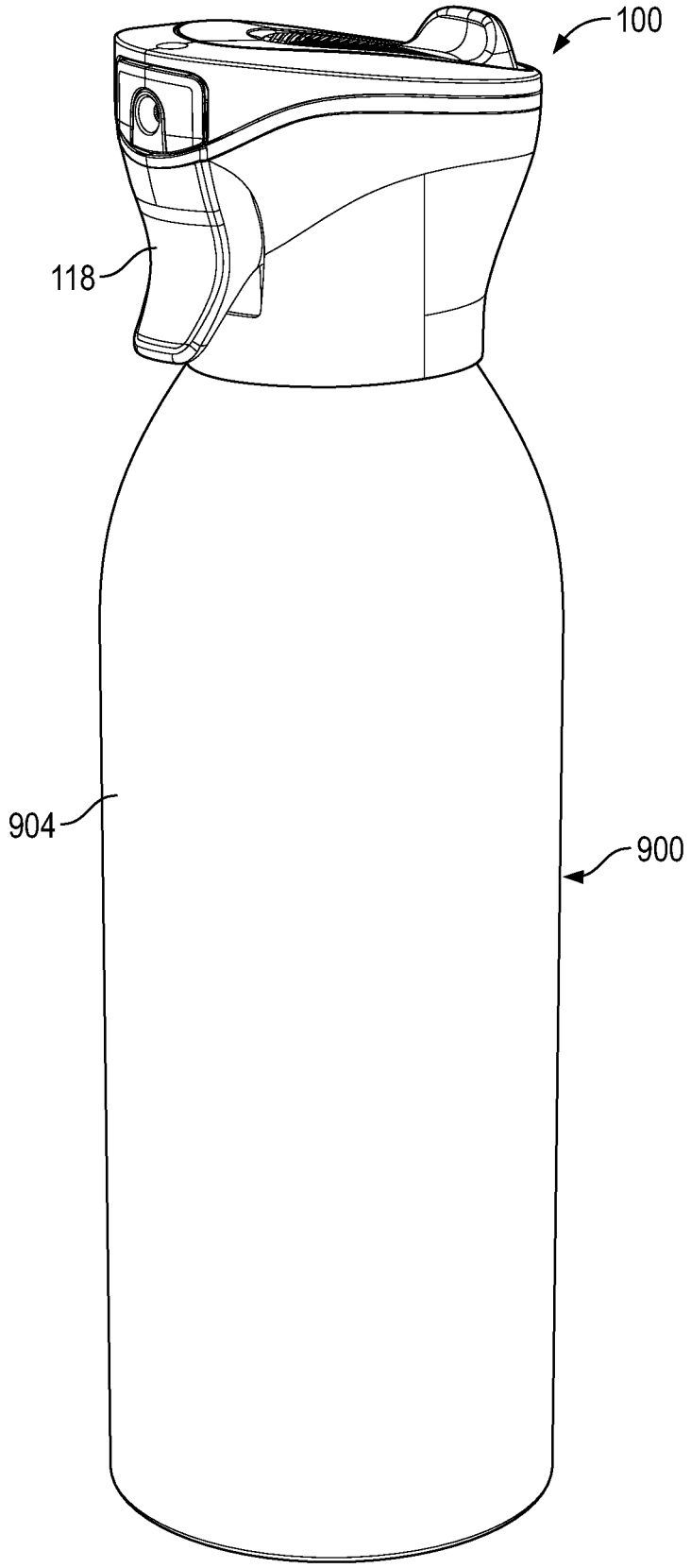
FIG. 1 is a perspective view of an exemplary embodiment of an aerosol sprayer and aerosol container in accordance with the teachings of the present disclosure.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

According to some embodiments of the invention, an aerosol sprayer may generally comprise a base configured to be received in assembled relation with an aerosol container, a nozzle including a manifold configured to be received in assembled relation with a valve stem of the aerosol container, a trigger pivotably attached to the base and operably engaged with the manifold, a cap received with the base, a sliding nozzle body received within the cap, and a trigger locking mechanism comprising interfitting locking formations on the nozzle and the trigger.

The nozzle includes a discharge orifice at an outlet end which is secured within an outlet end of the nozzle body, an aerosol stem manifold at an inlet end, and a discharge conduit extending therebetween wherein at least a portion of the discharge conduit adjacent to the manifold comprises flexible, articulating accordion-like wall structures to accommodate movement of the sliding nozzle body.

The nozzle body is slidably received within the guide channel wherein the nozzle body and the cap are configured and arranged for sliding movement of the nozzle body between a retracted (locked for shipping and storage) position and an extended position (operable use).

In use, the locking mechanism is engaged and the trigger is inoperable when the nozzle body is in the retracted position, and the locking mechanism is disengaged and the trigger is operable when the nozzle body is in the extended position. Furthermore, when the nozzle body is in an extended position, the aerosol orifice or spray exit is extended further away from the fingers or hand of an operator using the aerosol sprayer. Thus, any drips, residual collection of product, or errant spray from the aerosol sprayer is less likely to contact the user.

Aerosol sprayers according to various embodiments of the invention may be made from moldable resin or plastic materials or other desirable materials. For example, a base may be molded from any desired resin or plastic. Similarly, a trigger may be molded from any desired resin or plastic. The nozzle, manifold and flexible articulating features may be integrally molded from a medium-density or low-density polyethylene which is suitable for both the rigid and flexible portions of the nozzle structure. The materials used to form components of an aerosol actuator according to embodiments of the invention may also include other properties and may be colored in different manners to produce different aesthetic looks. For example, a base may be molded with one color and a trigger molded in another color. Embodiments of the invention are not limited by the material used to make the components of an aerosol actuator.

Aerosol sprayers according to various embodiments of the invention may be attached to any type of container as desired. For example, a conventional metal aerosol can may be used as a container with various embodiments of the invention. In other embodiments, a plastic container may be used. Also, any shaped container may be used with various embodiments of the invention.

During operation of an aerosol actuator connected to a container according to various embodiments of the invention, a force may be applied to a trigger portion of the aerosol actuator. As force is applied to the trigger portion, the manifold moves. Upon reaching a certain force, the manifold may move a distance sufficient to open a valve to which the manifold is attached, allowing product to flow from a container, through the valve and into a product flow path in the manifold. Product may then exit the orifice. Upon release or decreased force upon the trigger portion, the trigger and manifold return to a non-actuated state in which the valve is moved into a closed position and the flow of product through the manifold ceases. Actuation of the trigger may be repeated as desired.

Referring now to the drawing figures, an exemplary aerosol sprayer 100 according to certain embodiments may comprise a base 102 configured to be received in assembled relation with an aerosol container 900, a nozzle 104 with an integrated manifold 105 configured to be received in assembled relation with a valve stem 902 of the aerosol container, a trigger 106 pivotably attached to the base 102 and operably engaged with the manifold 105, a cap 108 received with the base 102, a sliding nozzle body 110 received within the cap 108, and a trigger locking mechanism 112 comprising interfitting locking formations on the nozzle body 110 and the trigger 106.

The aerosol container 900 includes a body portion 904, and an annular upper lip 906. The valve stem 902 may be centrally located within the annular lip 906 as known in the art.

The base 102 according to some embodiments of the invention may include snap features 114 or other container connections on a lower peripheral edge thereof which may snapfit or otherwise fasten to the lip 906 of the aerosol container or other container features. The base 102 may be shaped or configured to mate with and receive the trigger 106 which may extend through a window 116 or slot in front portion of the base. The trigger 106 may include an outward facing lever portion 118 or other feature to which force may be applied to move the manifold 105. The rearward portion includes a pivot 120 which may be snap received with a pivot mount 122 formed in the rearward portion of the base 102 whereby an inward and downward pivoting of the trigger 106 forcibly moves the manifold 105 to release aerosol product from the valve stem 902.

Figure 9:
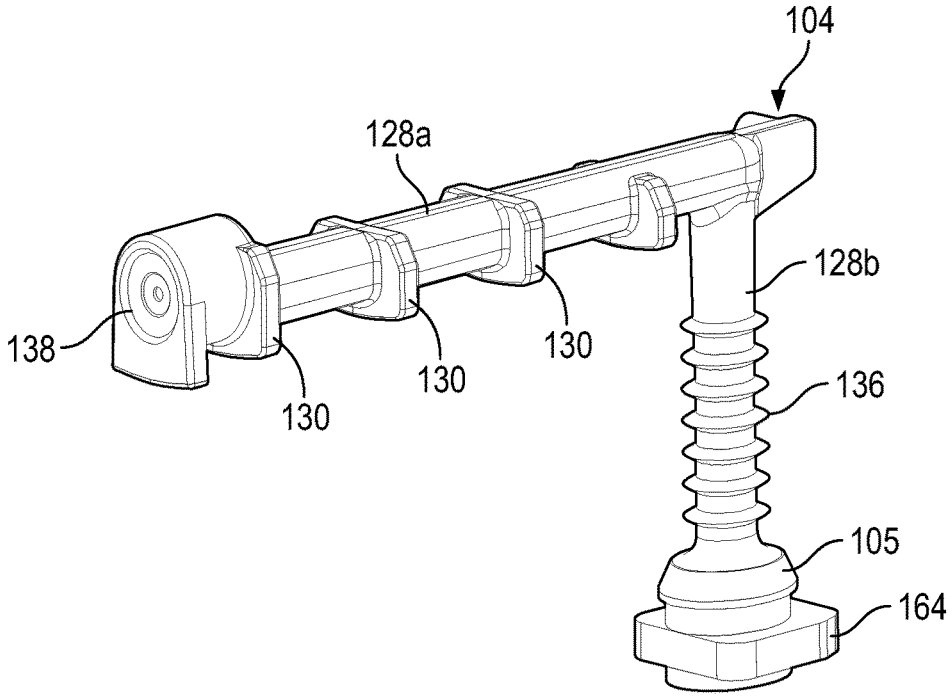
FIG. 9 is a perspective view of the nozzle with an integrated manifold.
Figure 10:
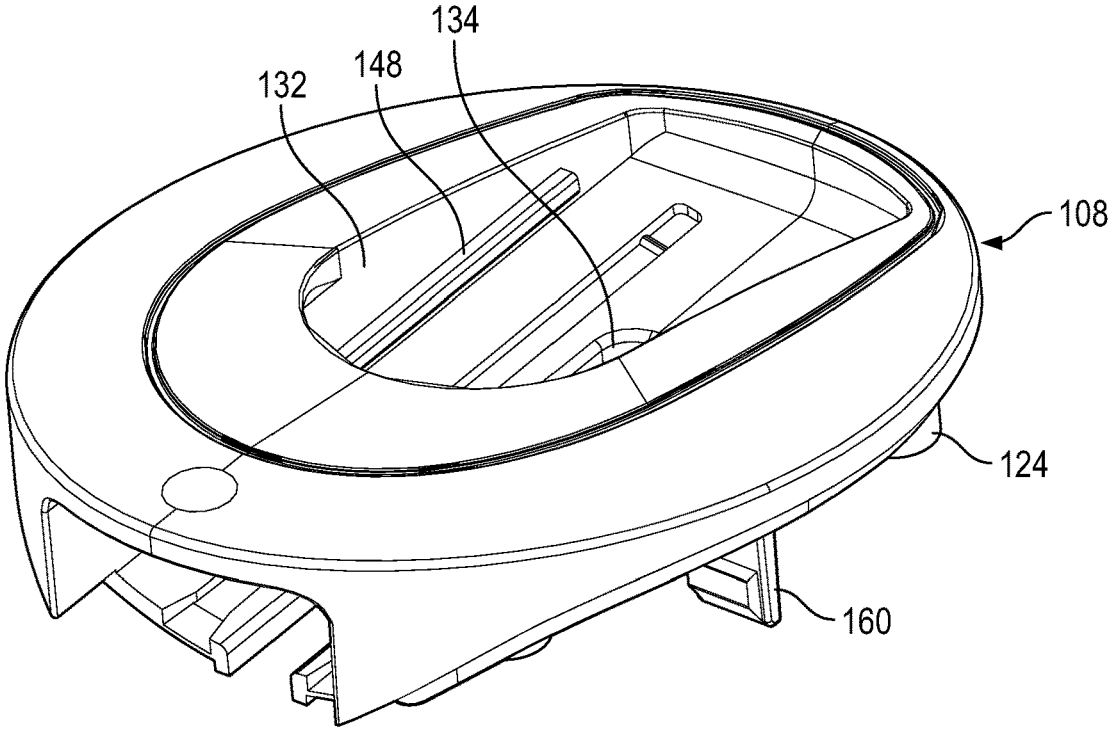
FIG. 10 is a top perspective view of the cap.
Figure 11:
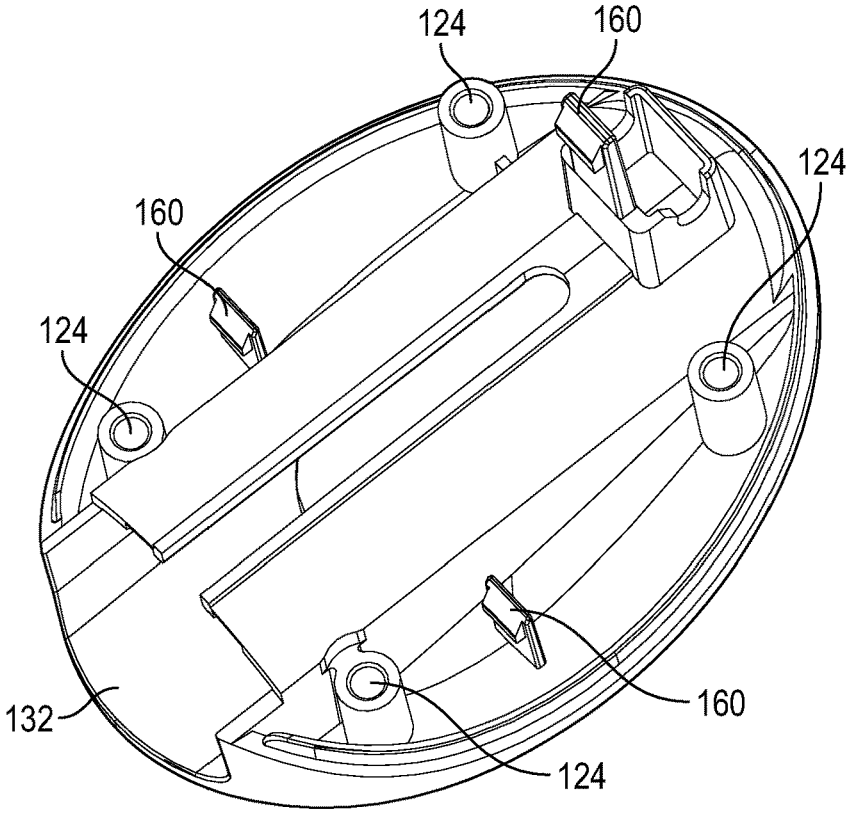
FIG. 11 is a bottom perspective view thereof.

Referring to FIG. 9, the nozzle 104 may be integrally molded or otherwise formed from a medium-density or low-density plastic material and may include a discharge orifice 138 at an outlet end which is secured within an outlet end of the nozzle body 110 and an aerosol manifold 105 at an inlet end and a discharge conduit 128 extending therebetween. The discharge conduit 128 provides a discharge path 142 from the manifold 105 to the discharge orifice 138. The discharge conduit 128 includes an elongated discharge portion 128*a* which is reinforced with ribs 130 to provide rigidity. Extending from the elongated discharge portion 128*a* is a manifold stem portion 128*b* joining the manifold 105 with the discharge portion 128*a*, wherein at least a portion of the discharge conduit (manifold stem portion 128*b*) adjacent to the manifold 105 comprises flexible, articulating wall structures 136 to accommodate movement of the sliding nozzle body 110. In some embodiments, these flexible articulating wall structures 136 may comprise accordion-like ridges similar to an articulating straw. The disclosure should not be limited by the illustrated embodiments.

In some embodiments, the cap 108 may include one or more interference fit post receptacles 124 or posts which may mate with or attach to one or more posts 126 or post receptacles of the base 102. In some embodiments, the cap 108 may further include one or more snap fit structures 160 which may mate with or attach to one or more corresponding snap fir structures 162 of the base 102. The post and snap fitments may provide support to the sprayer structure and may be used to hold the cap 108 in assembled relation with the base 102. The cap 108 may further include an elongated guide channel 132 on an upper surface thereof extending longitudinally front to back of the sprayer and in alignment with the pivoting plane of the trigger 106. A nozzle slot 134 may be provided through a bottom wall of the guide channel 132 to allow the stem portion 128*b* of the nozzle 104 to move relative to the cap 108.

Figure 2:
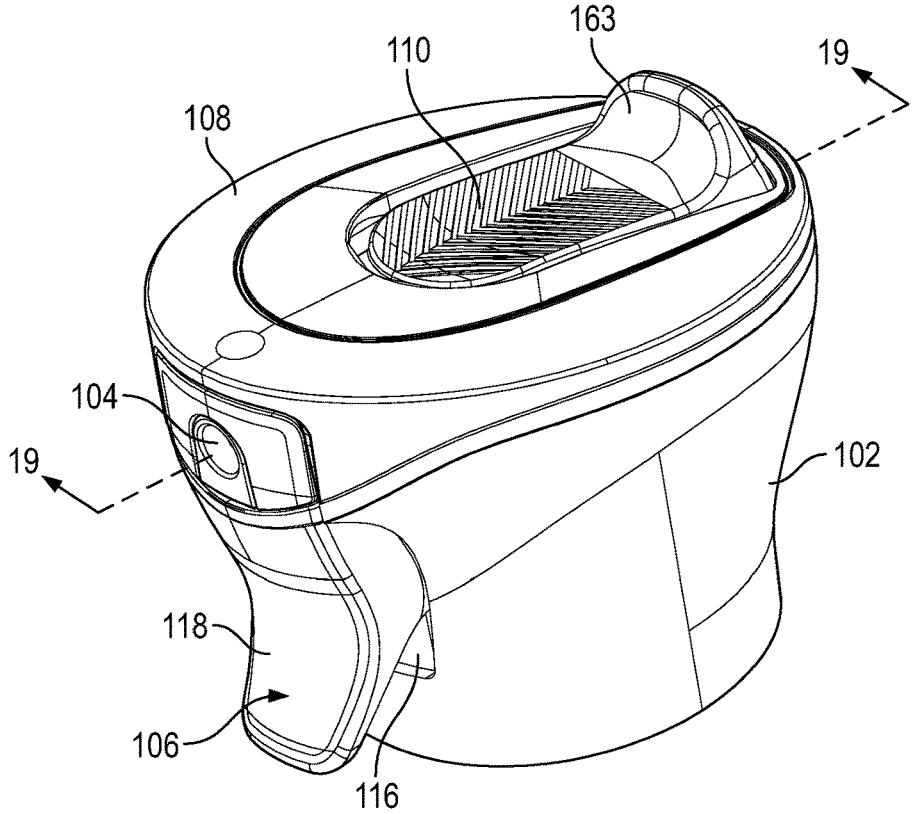
FIG. 2 is an enlarged perspective view of the aerosol sprayer.
Figure 3:
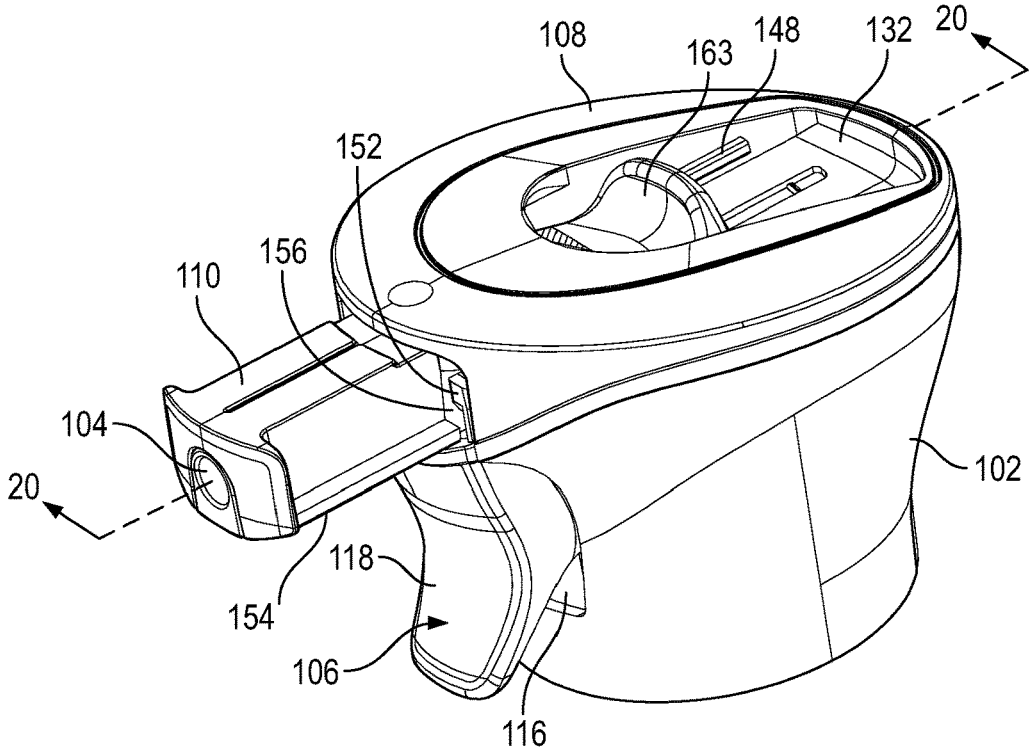
FIG. 3 is a perspective view thereof with the nozzle body in the extended position.
Figure 4:
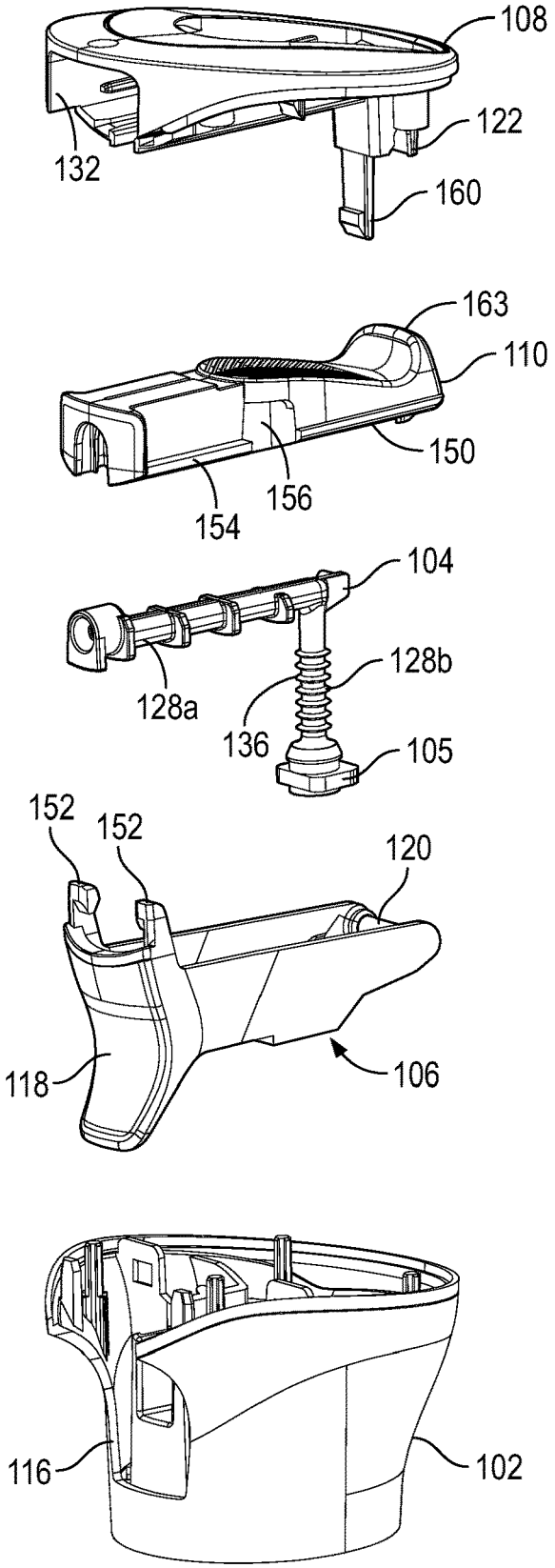
FIG. 4 is an exploded perspective view thereof.
Figure 5:
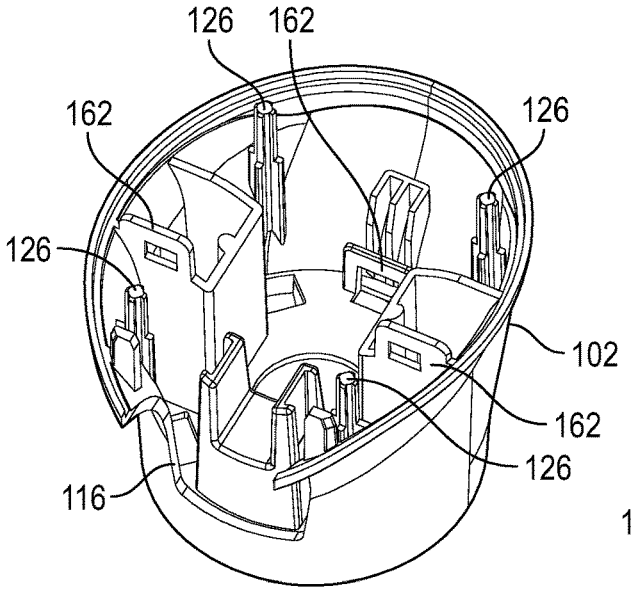
FIG. 5 is a top perspective view of a base portion of the sprayer.
Figure 6:
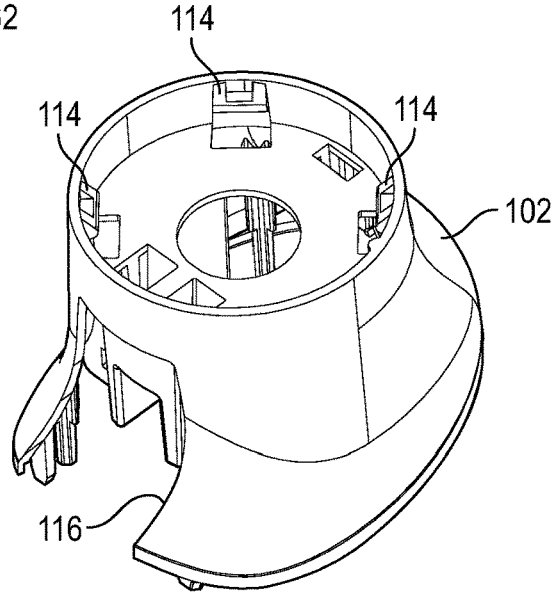
FIG. 6 is a bottom perspective view thereof.
Figure 7:
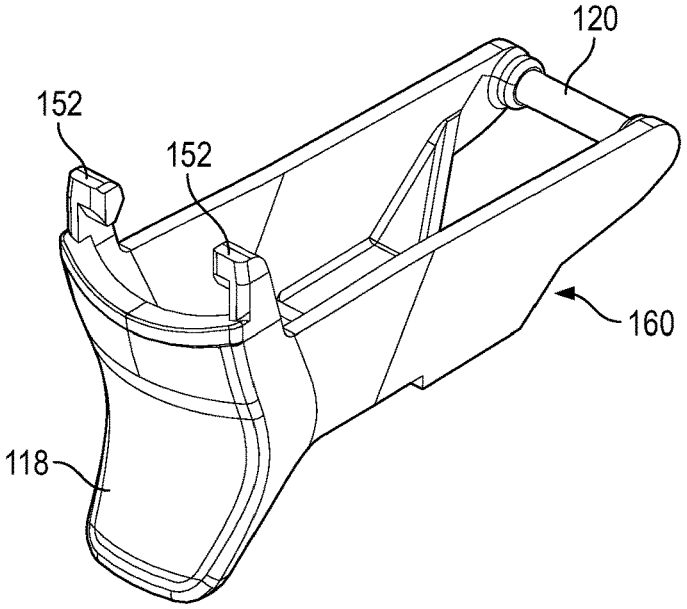
FIG. 7 is a perspective view of the trigger.
Figure 8:
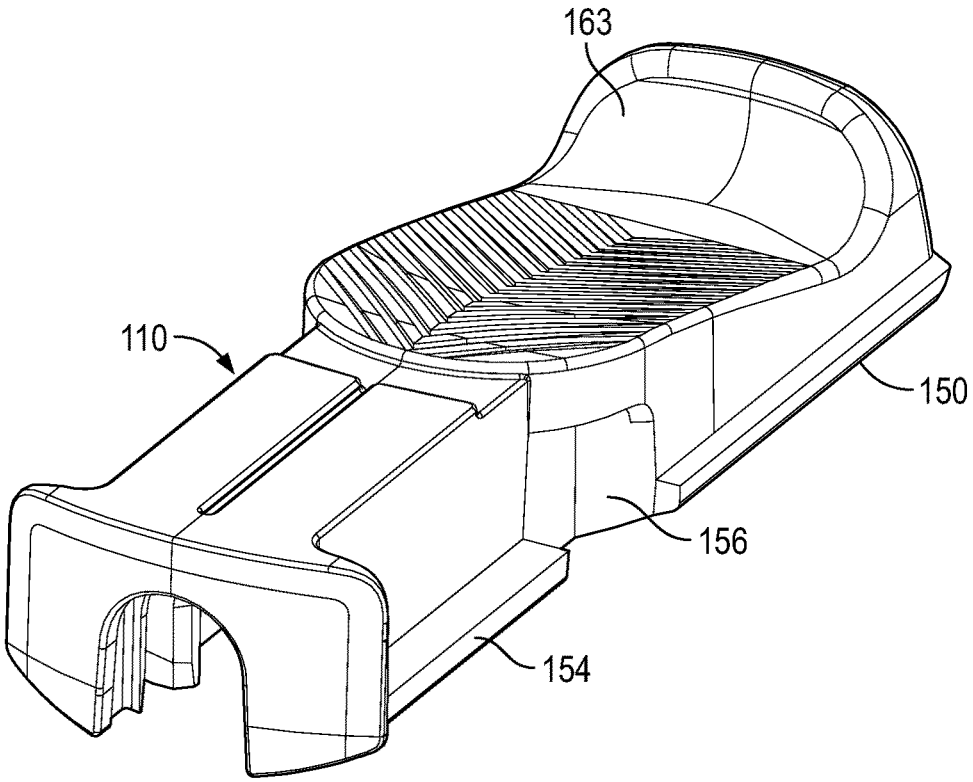
FIG. 8 is a perspective view of the sliding nozzle body.
Figure 12:
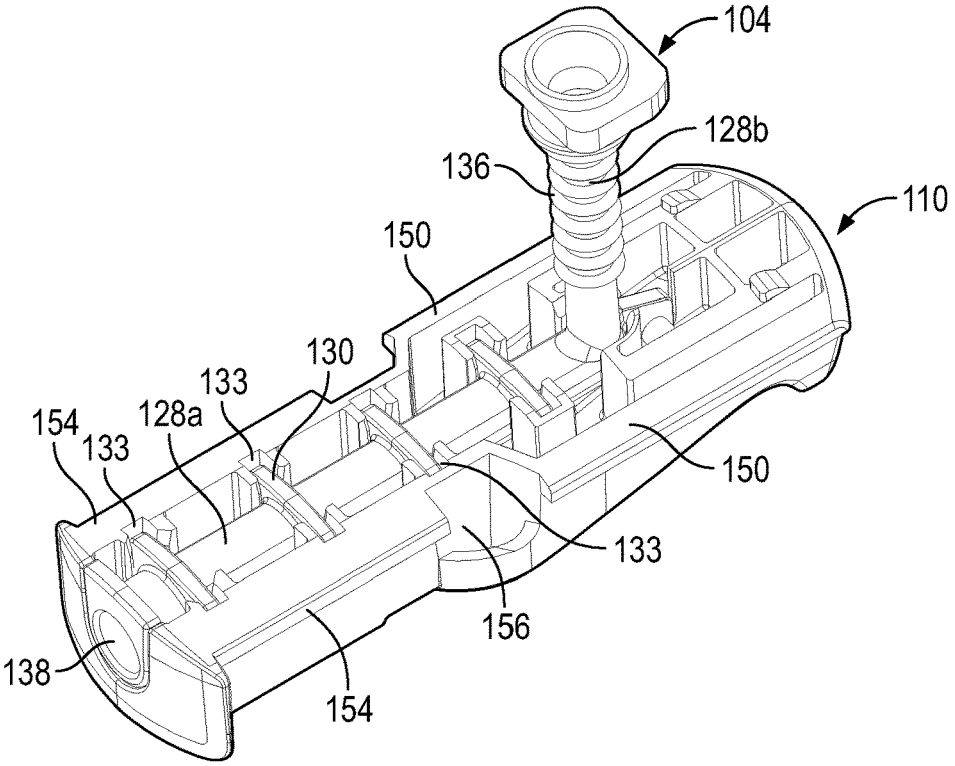
FIG. 12 is a bottom perspective view of the nozzle assembled with the nozzle body.
Figure 13:
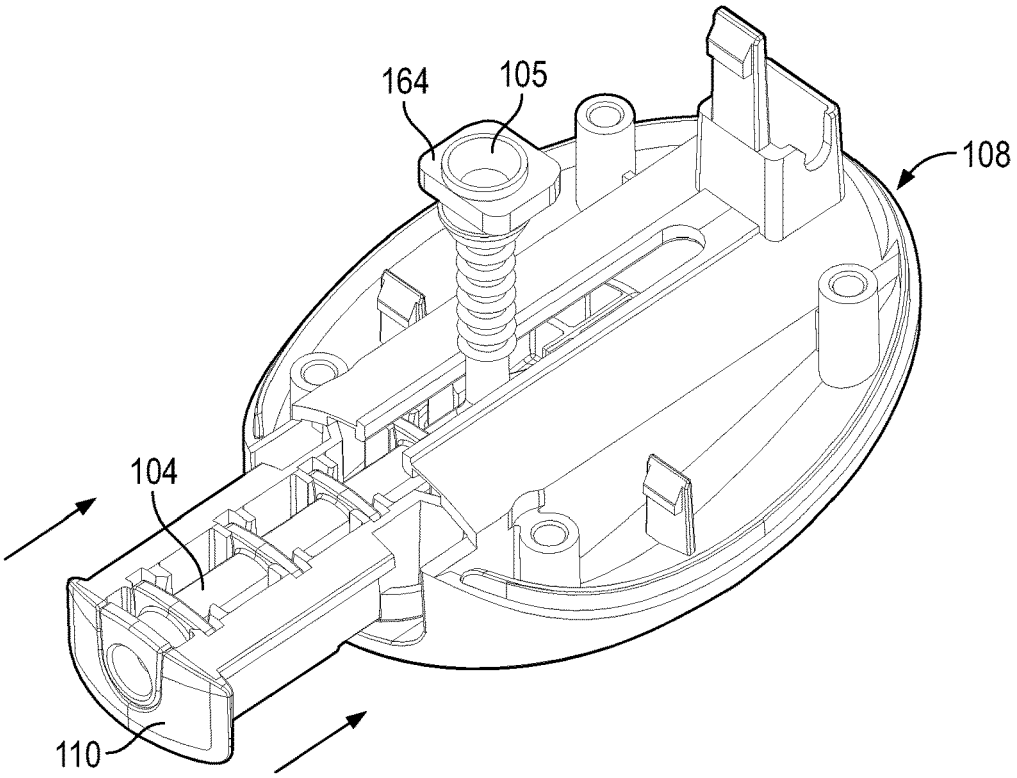
FIG. 13 is another bottom perspective view showing assembly of the nozzle and nozzle body into the guide channel of the cap.
Figure 16:
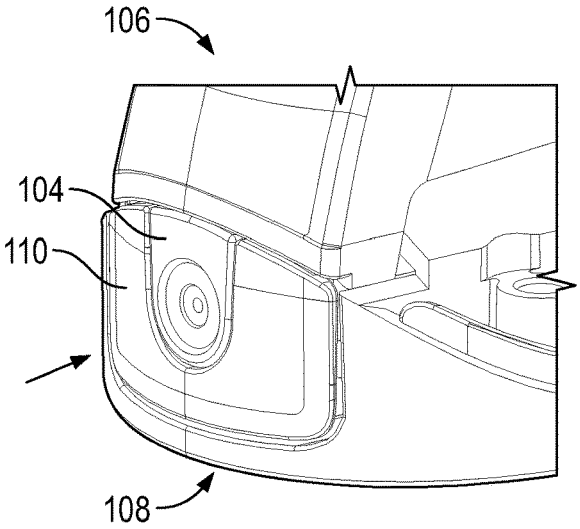
FIG. 16 is a perspective view showing the nozzle body fully inserted within the cap.

Referring to FIG. 12, the nozzle 104 is received in assembled relation into a channel on the underside of the nozzle body 110. The ribs 130 on the elongated discharge portion 128*a* of the nozzle 110 are snap received in an interference fit into corresponding notches 133 formed transverse to the channel. Turning to FIG. 13, the nozzle body 110 and nozzle 104 are slidably received within the guide channel 132 of the cap 108 wherein the nozzle body 110 and the cap 108 are configured and arranged for sliding movement of the nozzle body 110 between a retracted (shipping and storage) position (FIGS. 1, 2, and 19) and an extended (operable use) position (FIGS. 3, 16, and 20). FIG. 13 illustrates assembly of the nozzle body 110 and nozzle 104 into the guide channel 132 of the cap and orientation of the stem portion 128*b* of the discharge conduit 128 within the nozzle slot 134.

The nozzle body 110 and the guide channel 132 may include interfitting guides or shoulders for retaining the nozzle body 110 within the guide channel 132 and for guiding sliding movement of the nozzle body 110 within the guide channel 132. Some embodiments of the guides may include shoulders 148 formed on the side walls of the guide channel 132 and corresponding shoulders 150 formed on the outer side surfaces of the nozzle body 110. The nozzle body 110 may is some embodiments include a contoured shoulder tab 163 to facilitate actuation of the nozzle body 110 relative to the cap 108.

Figure 14:
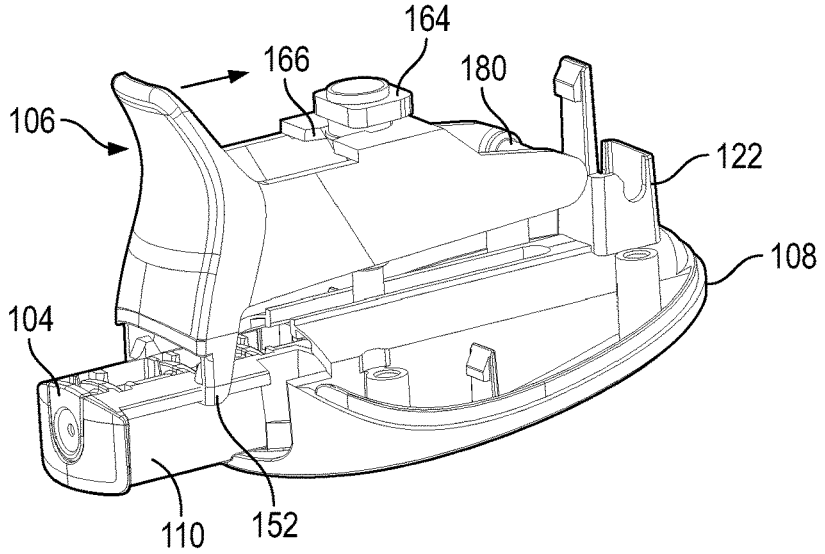
FIG. 14 is bottom perspective view showing assembly of the trigger with the nozzle body and nozzle.

The trigger 106 is assembled with the manifold 105 and nozzle body 110 by snapping a flanged base 164 of the manifold into a corresponding notch 1 formed in the trigger body 106 (See FIG. 14).

Some embodiments of nozzle body 110 and cap 108 may include interfitting detents (not shown) which indicate and define with a tactile snap action, the retracted and extended positions.

The locking mechanism 112 of the aerosol sprayer 100 may in some embodiments comprise a latch on the trigger 106 and a latch receiver on the nozzle body 110. More specifically, the latch may comprise opposed L-shaped latch arms 152 which extend upwardly and inwardly from a forward portion of the trigger 106. The corresponding latch receiver may comprise opposed elongated grooves or shoulders 154 on the side surfaces of the nozzle body 110. The rearward end of the grooves each include a release notch 156 which permits downward movement of the latch arms 152 during trigger operation when the nozzle 110 is in the extended position (See FIGS. 3, 14 and 16).

Figure 15:
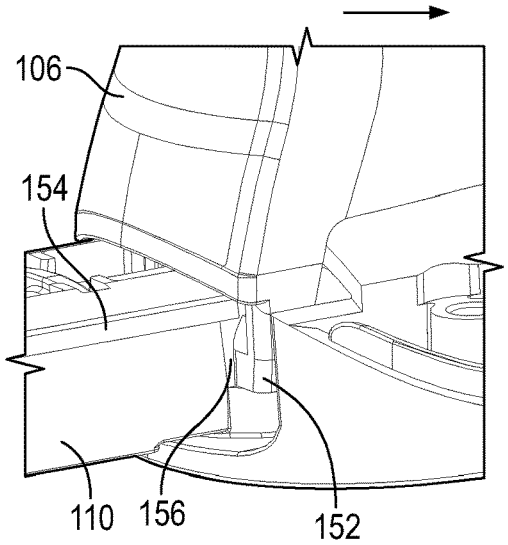
FIG. 15 is a perspective view showing the nozzle body extended with the trigger latch arms positioned in the latch grooves to allow actuation of the trigger.

FIG. 15 illustrates interaction of the trigger latch arms 152 within the release notches 156 during assembly and use. Referring to FIGS. 14 and 15, rearward movement of the trigger 106 and attached manifold 105 will bend the articulating wall structures 136 of the stem 128*b* creating a spring force. The trigger pivot 120 is slid over the rear snap fitment 160 and snapped down into the pivot mount 122 (FIG. 17).

Figure 17:
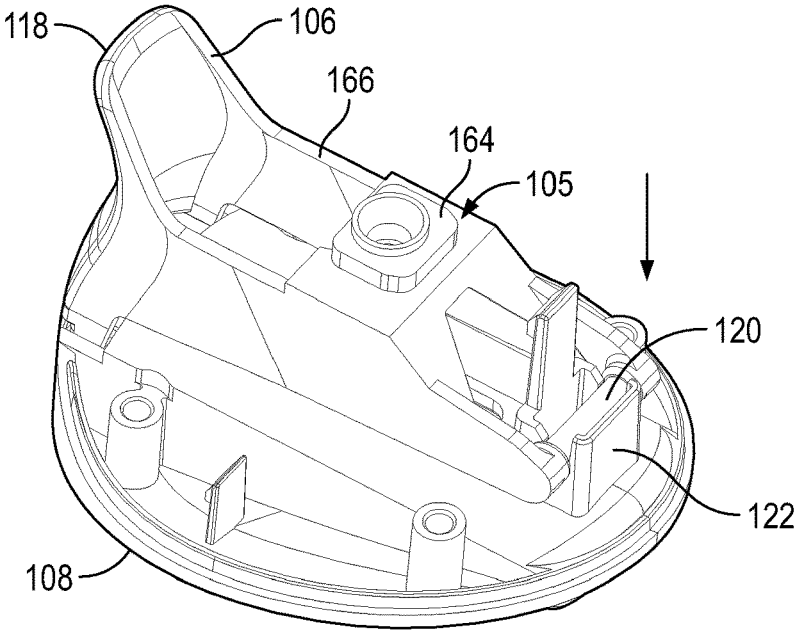
FIG. 17 is a bottom perspective view of the cap, nozzle body, nozzle and trigger assembly.

Pushing down on the front of the trigger 106 will pass the latch arms 152 through the release notch 156 into the groove 154 and allow full sliding movement of the nozzle body 110 into the cap (FIGS. 16 and 17). The elastomeric strength of the stem 128*b* will naturally push the back of the trigger 106 upwardly and retain the latch arms 152 within the grooved 154.

Figure 18:
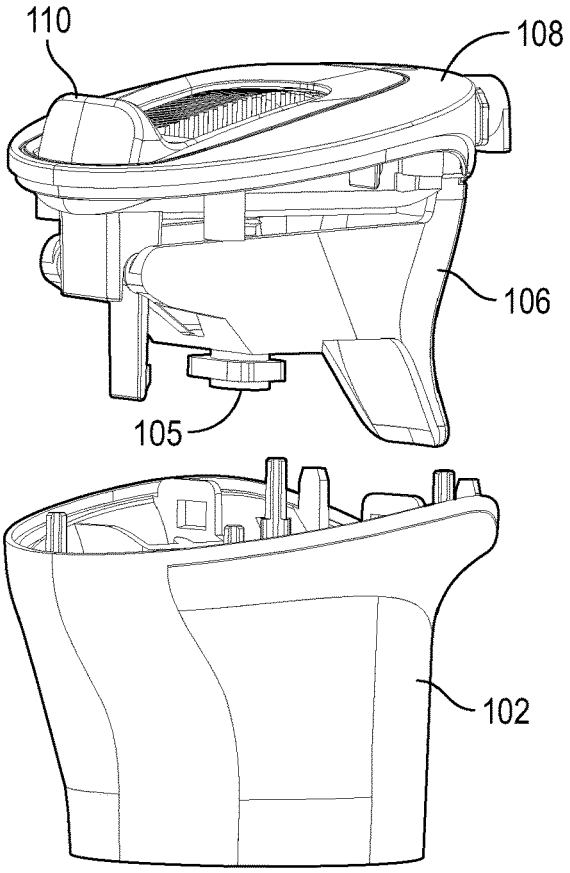
FIG. 18 is a perspective view showing the cap, nozzle body, nozzle and trigger assembly being assembled with the base.

Thereafter the assembled nozzle 104, nozzle body 110, trigger 106 and cap 108 are snap fit with the base 102 interlocking the fitment structures 124, 126, 160, 162 (FIG. 18) and seating the manifold 105 onto the aerosol valve stem 902.

Figure 19:
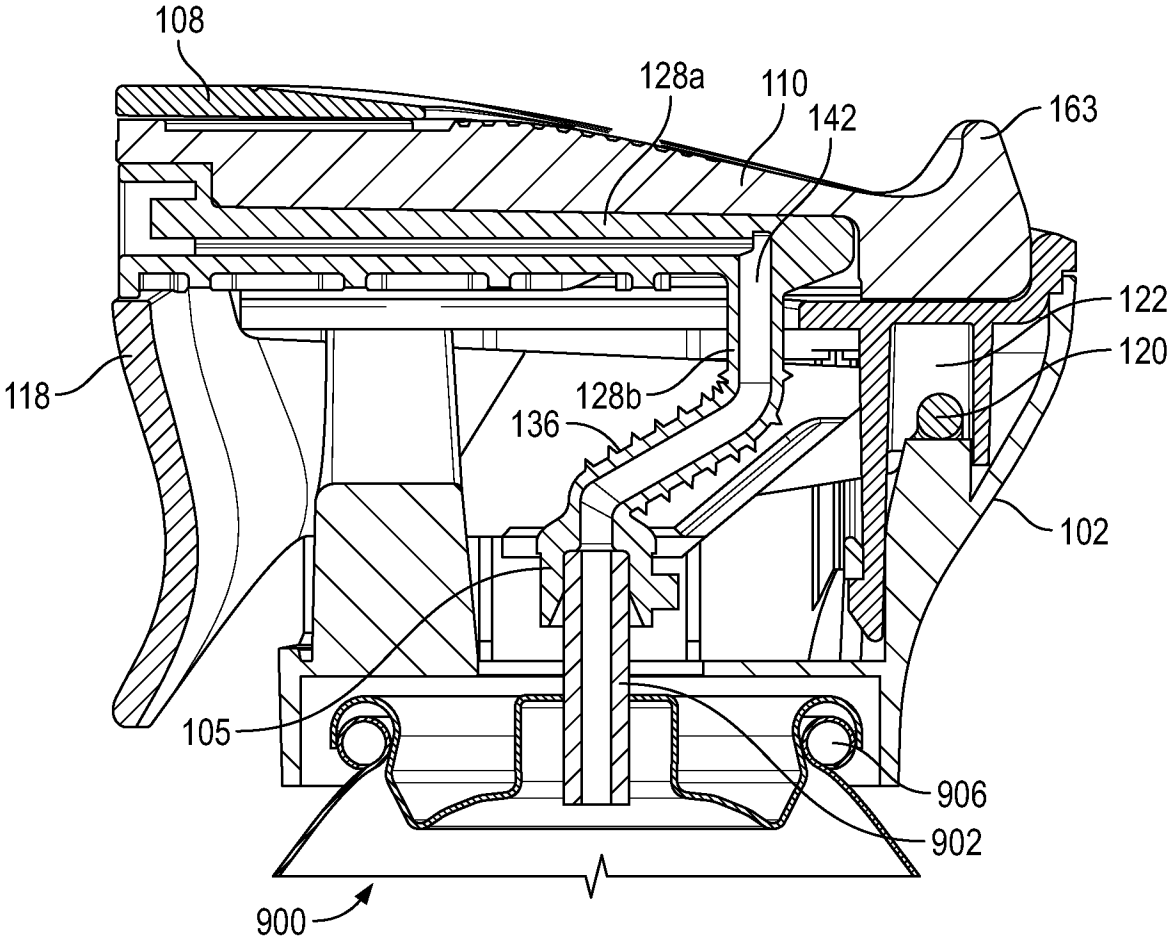
FIG. 19 is a cross-sectional view thereof taken along line 19-19 of FIG. 2.
Figure 20:
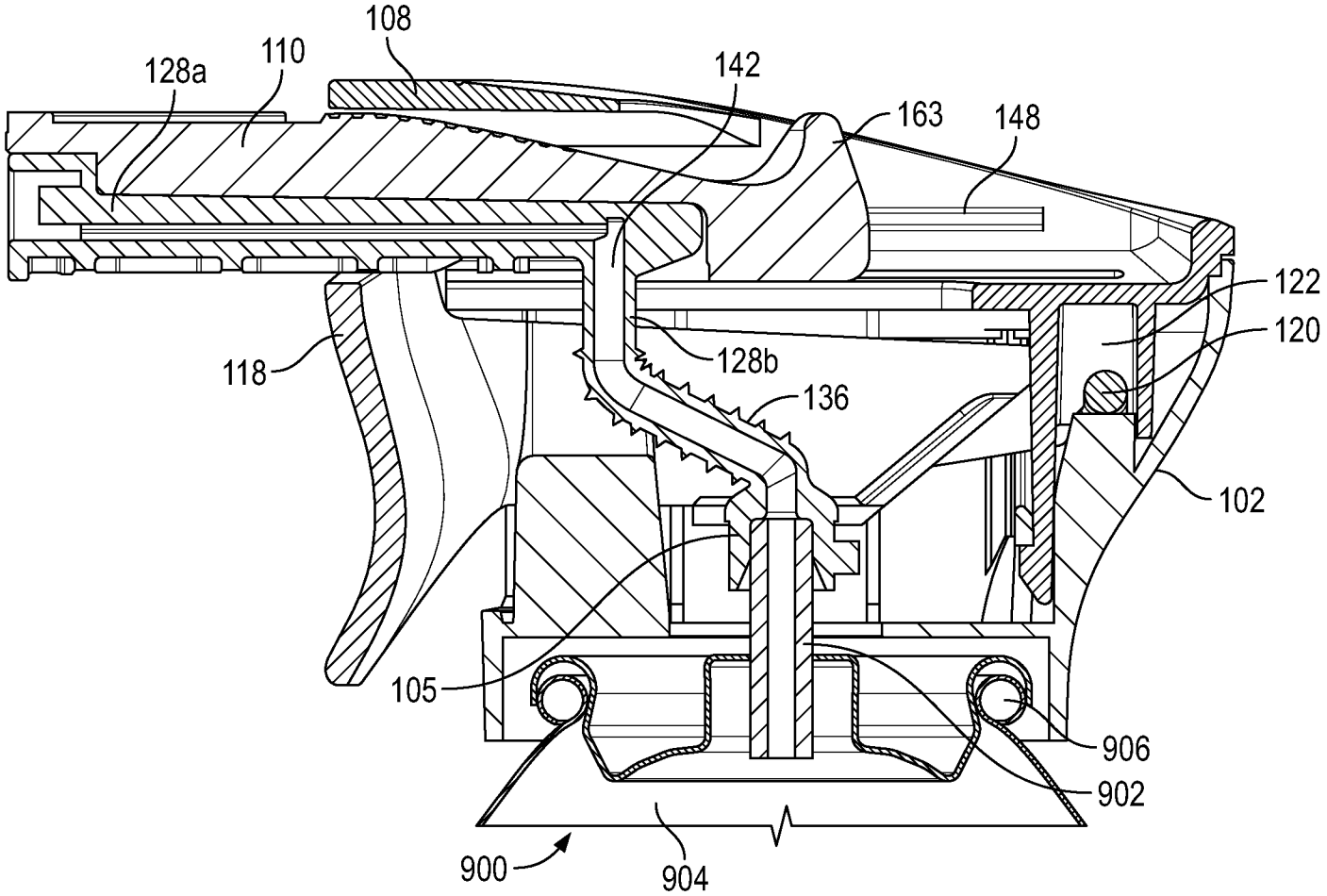
FIG. 20 is a cross-sectional view thereof taken along line 20-20 of FIG. 3.

Referring to the cross-sectional FIGS. 19 and 20, sliding movement of the nozzle body 110/nozzle 104 relative to the cap 108 and articulating movement of the manifold stem 128*b* relative to the nozzle body 110 and manifold 105 seated on the aerosol valve stem 902.

The locking mechanism 112 is locked and the trigger is inoperable when the nozzle 110 is in the retracted position. In this regard, the latch arms 152 sit on top of the retaining shoulders 154 on the nozzle body 110 and prevent downward movement of the trigger 106. The articulating discharge stem 128*b* is seen to bent rearwardly within the cap 108.

The locking mechanism 112 is released and the trigger 106 is operable when the nozzle body 110 is slid forwardly into the extended position. In this regard, the latch arms 152 are aligned within the release notches 156 allowing downward movement of the trigger 106. As force is applied to the trigger 106, the manifold 105 moves. Upon reaching a certain force, the manifold 105 may move a distance sufficient to open the valve 902 on which the manifold 105 is seated, allowing product to flow from the container 904, through the valve 902 and into discharge conduit 128.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An aerosol sprayer comprising:

a base configured to be received in assembled relation with an aerosol container;

a nozzle having a discharge orifice at an outlet end, a manifold at an inlet end, and a discharge conduit extending therebetween wherein at least a portion of the discharge conduit adjacent to the manifold comprises flexible, articulating wall structures, said manifold configured to be received in assembled relation with a valve stem of said aerosol container;

an elongated nozzle body having an outlet end and an actuator end, said outlet end of said nozzle being received and secured within said outlet end of said nozzle body;

a trigger pivotably attached to said base and operably engaged with said manifold; and a cap received on the base and having a guide channel therein, said cap further having a conduit slot in a bottom wall of said guide channel receiving said discharge conduit, said nozzle body being slidably received within said guide channel, said nozzle body and said cap being configured and arranged for sliding movement of said nozzle body between a retracted position and an extended position.

2. The aerosol sprayer of claim 1 wherein said discharge conduit comprises a rigid portion adjacent said outlet end.

3. The aerosol sprayer of claim 2 wherein said flexible articulating wall structures comprise articulating accordion ridges.

4. The aerosol sprayer of claim 2 further comprising a trigger lock.

5. The aerosol sprayer of claim 4 wherein said trigger lock comprises a latch on said trigger and a latch receiver on said nozzle body.

6. The aerosol sprayer of claim 5, wherein said latch and said latch receiver comprise two symmetrically spaced latches extending upwardly from said trigger and two respective symmetrically spaced latch receiver grooves extending longitudinally along said nozzle body, said receiver grooves having downwardly opening release notches at rearward ends thereof.

7. The aerosol sprayer of claim 6 wherein each of said spaced latches comprises an L-shaped arm extending upwardly and inwardly from said trigger.

8. The aerosol sprayer of claim 1 wherein said flexible articulating wall structures comprise articulating accordion ridges.

9. The aerosol sprayer of claim 8 further comprising a trigger lock.

10. The aerosol sprayer of claim 9 wherein said trigger lock comprises a latch on said trigger and a latch receiver on said nozzle body.

11. The aerosol sprayer of claim 1 wherein said actuator end of said nozzle body includes a contoured shoulder tab.

12. The aerosol sprayer of claim 1 further comprising a trigger lock.

13. The aerosol sprayer of claim 12 wherein said trigger lock comprises a latch on said trigger and a latch receiver on said nozzle body.

14. The aerosol sprayer of claim 13, wherein said latch and said latch receiver comprise two symmetrically spaced latches extending upwardly from said trigger and two respective symmetrically spaced latch receiver grooves extending longitudinally along said nozzle body, said latch receiver grooves having downwardly opening release notches at rearward ends thereof.

15. The aerosol sprayer of claim 14 wherein each of said spaced latches comprises an L-shaped arm extending upwardly and inwardly from said trigger.

16. An integrally formed aerosol nozzle comprising a discharge orifice at an outlet end, a manifold at an inlet end, and a discharge conduit extending therebetween said discharge conduit including an elongated rigid discharge portion adjacent said discharge orifice and a manifold stem portion adjacent said manifold, wherein said rigid discharge portion includes reinforcing ribs, wherein at least a portion of the manifold stem portion comprises flexible, articulating wall structures, said flexible articulating wall structures comprise articulating accordion ridges, said manifold configured to be received in assembled relation with a valve stem of an aerosol container.

17. The aerosol nozzle of claim 16 wherein the rigid discharge portion and the manifold stem portion are not on the same axis.

* * * * *